United States Patent [19]

Schaming

[11] 4,400,961

[45] Aug. 30, 1983

[54] APPARATUS FOR REMOVING LIQUID COOLANT FROM METAL STRIPS IN A ROLLING MILL

[76] Inventor: Edward J. Schaming, P.O. Box 1070, Butler, Pa. 16001

[21] Appl. No.: 283,644

[22] Filed: Jul. 15, 1981

[51] Int. Cl.[3] ..... B21B 27/10; B21B 45/02

[52] U.S. Cl. ..... 72/201

[58] Field of Search ..... 72/39, 45, 201, 236; 134/10, 15, 21, 64 R, 122 R, 198; 164/89, 444; 239/120, 549, 551, 556, 562, 563; 266/113; 15/306 A, 316 R, 345

[56] References Cited

U.S. PATENT DOCUMENTS

| | | | |
|---|---|---|---|
| 1,739,593 | 12/1929 | Inglefield et al. | 15/306 A |
| 3,192,752 | 7/1965 | Dowd et al. | 72/45 |
| 3,736,618 | 6/1973 | Ramsay | 15/306 A |
| 3,889,507 | 6/1975 | Kranenberg et al. | 72/201 |
| 3,994,151 | 11/1976 | Stock et al. | 72/201 |
| 4,247,047 | 1/1981 | Schaming | 72/201 X |

FOREIGN PATENT DOCUMENTS

| | | | |
|---|---|---|---|
| 431027 | 6/1935 | United Kingdom | 72/44 |
| 1481022 | 7/1977 | United Kingdom | 15/306 A |

*Primary Examiner*—Ervin M. Combs
*Attorney, Agent, or Firm*—D. Paul Weaver

[57] ABSTRACT

While liquid coolant in the form of pressurized sprays is being delivered onto the upstream sides of the working rolls in a rolling mill across the width of the moving metal strip, pressurized fluid jets are directed against the opposite end portions of the working rolls outwardly of the longitudinal edges of the strip, said jets being aimed axially outwardly toward the ends of the working rolls and somewhat upwardly and downwardly in relation to the top and bottom faces of the strip. Closely beyond the downstream sides of the working rolls, additional pressurized fluid jets are directed downwardly and upwardly against the moving strip with the air concentrated near its longitudinal edges to dislodge any remaining coolant. Simultaneously, aspirators within suction headers are energized to pull atomized coolant from the regions immediately above and below the strip and deliver it to a remote reclaiming point so that the coolant removed from the strip is not allowed to contaminate the surrounding work environment. Staining of the metal strip by the coolant is effectively prevented.

5 Claims, 9 Drawing Figures

FIG.1
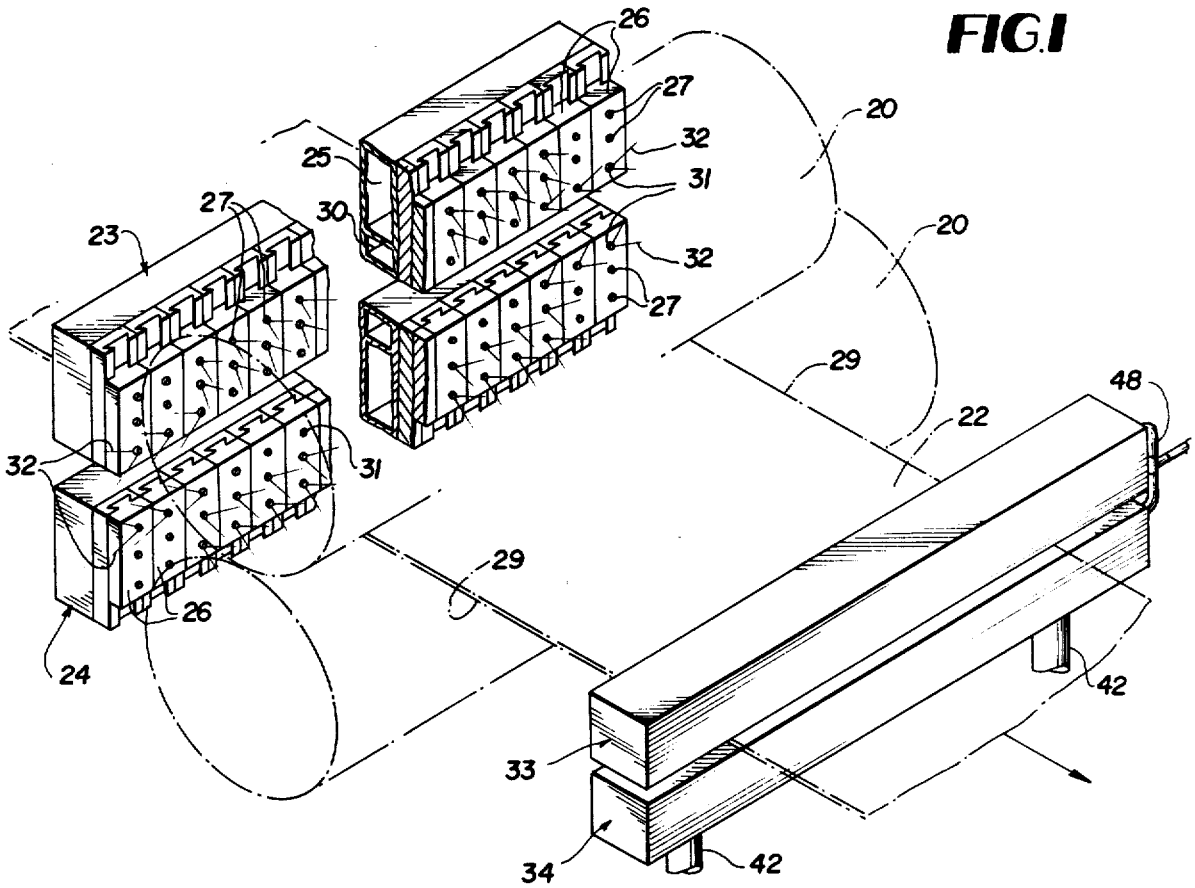
FIG.6
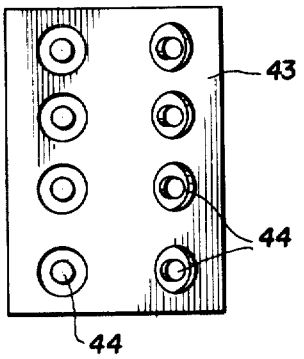
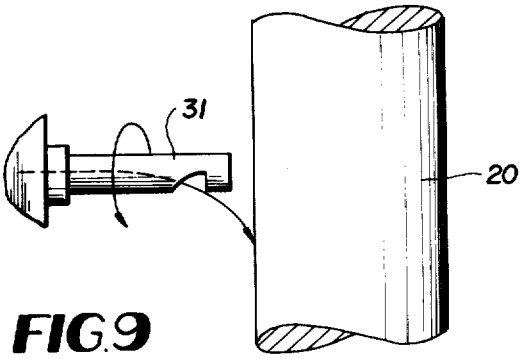
FIG.9
FIG.8
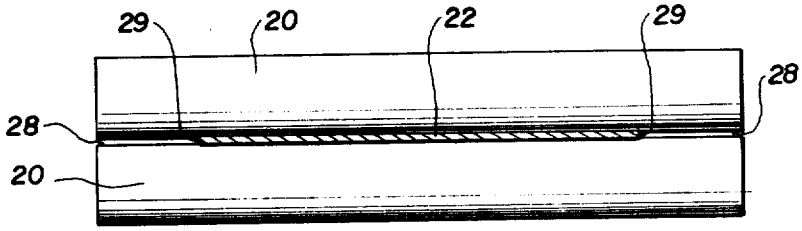

FIG.5
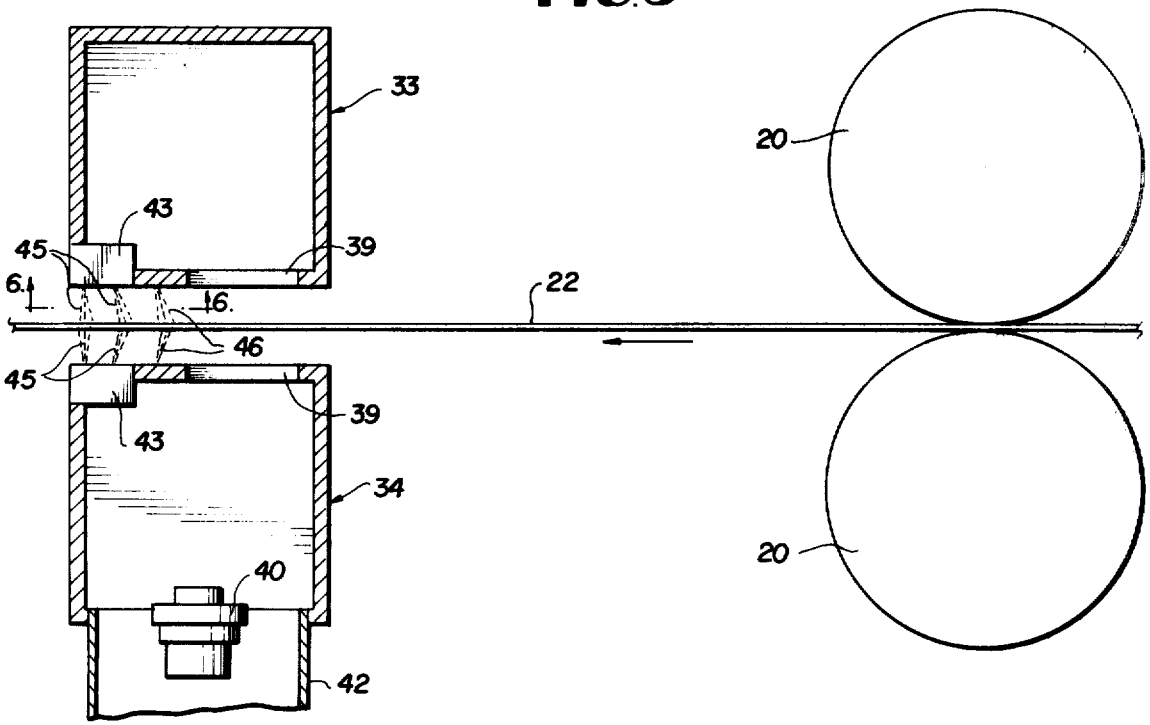
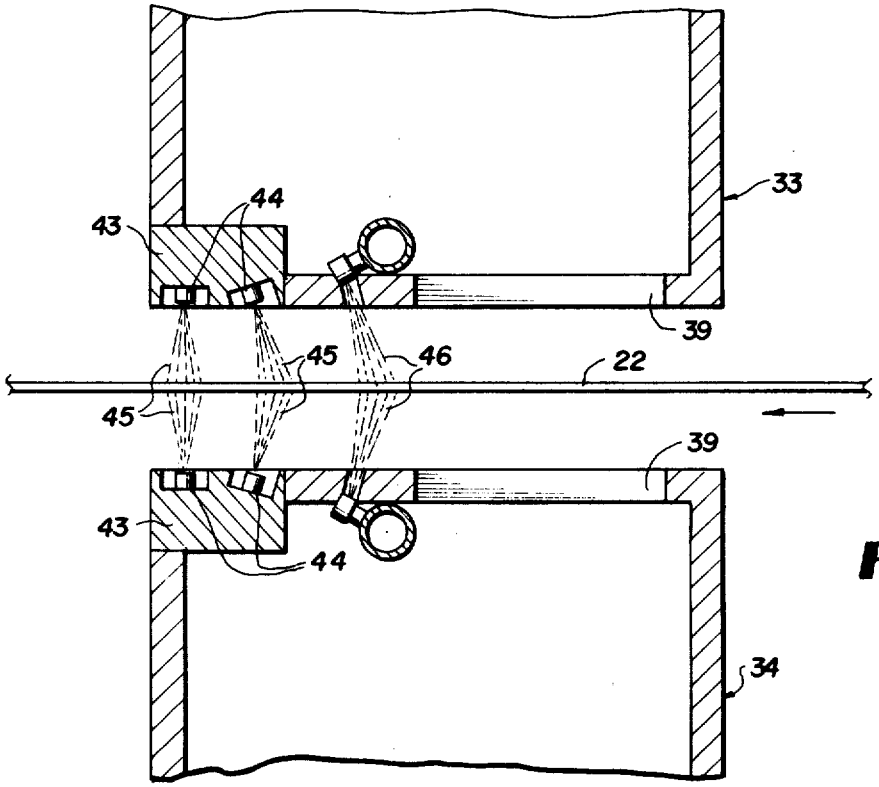
FIG.7

APPARATUS FOR REMOVING LIQUID COOLANT FROM METAL STRIPS IN A ROLLING MILL

BACKGROUND OF THE INVENTION

Modern metal rolling mills advance a metal strip on a pass line between working rolls at speeds up to 6000 feet per minute. To efficiently cool the rolls of such high speed mills, sophisticated liquid coolant systems are employed to direct coolant sprays in adequate amounts onto the working rolls. U.S. Pat. No. 4,247,047 issued Jan. 27, 1981 for a MODULAR ZONED DIGITAL COOLANT CONTROL SYSTEM FOR STRIP MILL ROLLS reflects the latest technology for this purpose. In the patent, banks of digitally controlled coolant nozzles contained in common coolant header valve modules are selectively turned off or turned on in zones to supply with precision the amounts of liquid coolant necessary to maintain the proper condition of the metal strip passing at high speed through the mill rolls.

The diverse usage of the rolled metal strip in today's manufacturing processes has created a new problem which heretofore has not been dealt with in any orderly and satisfactory manner. This problem is the permanent staining of the metal strip by the coolant liquid in the mill to such an extent that the strip is unacceptable to product manufacturers and end users. This staining is caused by allowing liquid coolant to remain on one or both surfaces of the strip after the strip passes through the working rolls and is coiled by a conventional coiler.

Accordingly, the objective of the present invention is to deal successfully with this problem of the industry through provision of a pneumatic system employed in concert with a liquid coolant distribution system to effectively clean or remove substantially all coolant from the metal strip near its exit from the working rolls and before the strip reaches the coiler.

More particularly, it is the objective of the invention to provide a coolant removing apparatus and method in which about 80% of the liquid coolant is removed at the upstream sides of the working rolls through the action of pressurized air jets which prevent the passage of liquid coolant through the gaps between the working rolls outwardly of the longitudinal edges of the metal strip, followed by the removal of substantially all remaining coolant near the downstream sides of the rolls by the combined action of positive pressure air jets on opposite sides of the strip to dislodge the coolant so as to render it airborne and the simultaneous action of an aspirator system to pull the airborne droplets away from the strip and deliver them to a remote reclaiming or recycling point where the valuable liquid can be recovered and reused. This aspirating operation prevents polluting of the atmosphere in the vicinity of the working rolls and liquid coolant apparatus.

Still another object of the invention is to provide a pneumatic liquid coolant removal system which can form an integral part of the digital coolant control system in U.S. Pat. No. 4,247,047, thus constituting an important improvement on that patent.

A further object is to provide an efficient and economical coolant removal system for a strip rolling mill which is rugged and durable, compact and easy to maintain.

Other features and advantages of the invention will become apparent during the course of the following detailed description.

BRIEF DESCRIPTION OF THE DRAWINGS

FIG. 1 is a fragmentary perspective view of a coolant removal apparatus, the upstream components of which form an integral part of a digital coolant distribution system, all shown on a partly schematic basis.

FIG. 5 is a vertical section taken on line 5—5 of FIG. 3.

FIG. 6 is a fragmentary section taken on line 6—6 of FIG. 5.

FIG. 7 is an enlarged partly schematic view showing the pneumatic jet or spray arrangement of the downstream component.

FIG. 8 is an enlarged fragmentary transverse vertical section taken on line 8—8 of FIG. 2.

FIG. 9 is an enlarged fragmentary elevational view of a rotationally adjustable air nozzle.

DETAILED DESCRIPTION

Figure 2:
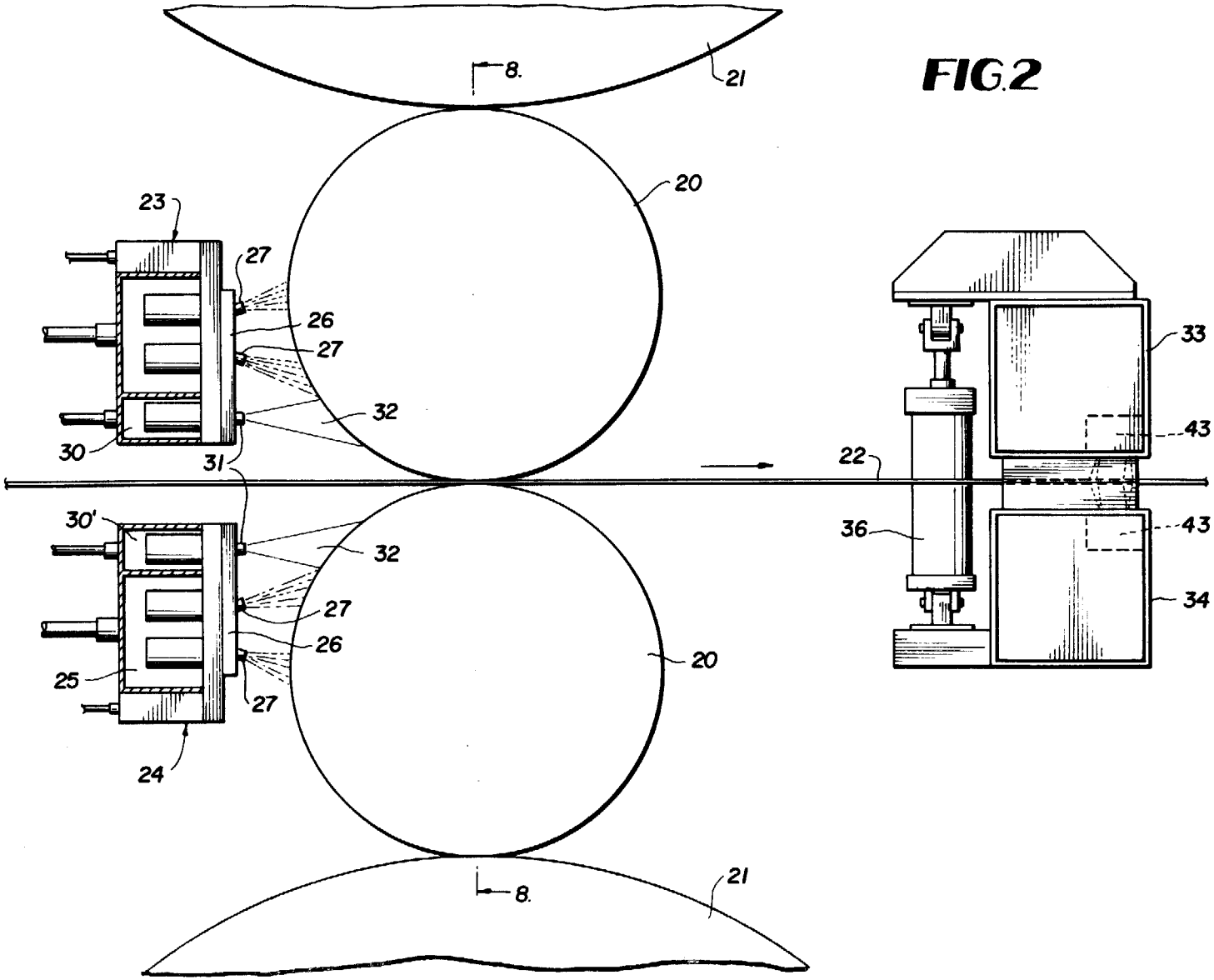
FIG. 2 is a partly schematic side elevation of the coolant removal system in FIG. 1.
Figure 3:
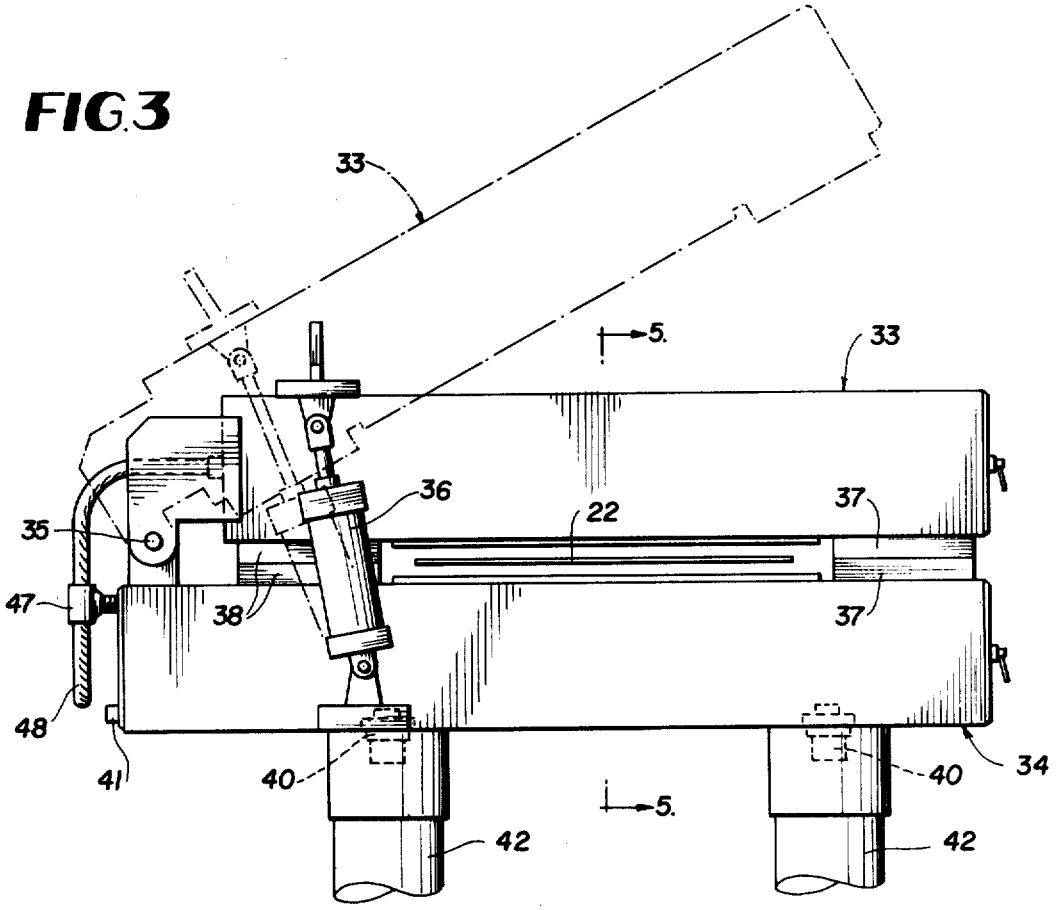
FIG. 3 is a side elevation of the downstream component of the coolant removal apparatus as viewed across the axis of the metal strip passing through the mill.

Referring to the drawings in detail wherein like numerals designate like parts, a typical strip rolling mill is depicted in FIG. 2 having a pair of working rolls 20 and a cooperating pair of back-up rolls 21 of substantially larger diameters. A flat strip 22 of aluminum or the like passes between the working rolls 20 during the operation of the mill at a high speed, such as 6000 feet per minute.

To cool the working rolls 20 during the rolling of the strip 22, zoned modular digitally controlled upper and lower liquid coolant distribution units 23 and 24 are provided above and below the strip 22 and near the entrance or upstream sides of the working rolls substantially in accordance with the teachings of U.S. Pat. No. 4,247,047. As described in said patent, each unit 23 and 24 comprises a liquid coolant header 25 in common communication with a plurality of side-by-side modular coolant distribution valve and spray nozzle assemblies 26 mounted thereon. The activation and de-activation of the coolant spray nozzles 27 of assemblies 26 is controlled by an observer at the mill through a remote push button control console, as fully disclosed in the referenced patent. The arrangement is such that the coolant spray nozzles of the modules 26 can be turned on or turned off in zones across the strip 22, and individual nozzles 27 of the modules 26 can be turned off or turned on selectively to meet the exact requirements for cooling.

In order to remove approximately 80% of the coolant at the upstream sides of the roll 20, and to prevent this coolant from passing through the work roll gaps 28 outwardly of the longitudinal edges 29 of the metal strip and thus reaching the downstream sides of the rolls, the following provision is made on the upstream units 23 and 24.

The bottom of the upper unit 23 below its coolant header 25 is provided with a separated integral air manifold 30 in common communication with a lower bank of remotely digitally controlled valve and nozzle units 31.

This lower bank or row of pneumatic nozzles 31 is identical in construction and operation to the liquid coolant nozzles 27, the only difference being that compressed air from a remote source, not shown, is delivered to the air manifold 30 whereas a liquid coolant under pressure, such as oil, is delivered to the header 25. The operation is in accordance with U.S. Pat. No. 4,247,047, both with respect to the coolant nozzles 27 and the air nozzles 31 and their associated valves.

In a similar manner, the lower unit 24 of the upstream component has a top integral air manifold 30' in common communication with the top row of valve and air nozzle assemblies 31 thereon.

In the operation of the system, depending on the width of the metal strip 22, the pneumatic nozzles 31 along the bottom of upper unit 23 and along the top of lower unit 24 which lie outwardly of the two longitudinal edges 29 of strip 22 are selectively activated by the operator at the digital control console according to the referenced patent. The other nozzles of the system in communication with the coolant headers 25 are selectively digitally controlled to supply liquid coolant on the two rolls 20 in the proper zones or areas.

The air nozzles 31, which are rotationally adjustable outwardly of the strip edges 29, direct fan-like slightly overlapping air blasts 32 shown graphically in the drawings outwardly and away from the edges 29 and somewhat upwardly on the upper unit 23 and somewhat downwardly on the lower unit 24. The effect of the air blasts or sprays when so directed drives the liquid coolant away from the traveling strip 22 and toward the opposite ends of the two rolls 20 projecting beyond the longitudinal edges of the strip. The liquid coolant is prevented by the air blasts from passing through the gaps 28 and thereby reaching the downstream side of the working rolls. The operation is very effective and 80% or more of the liquid coolant being delivered onto the upstream sides of the rolls is prevented from reaching their downstream sides. The natural squeegee action of the rolls 20 acting on the strip 22 across the width of the latter blocks the passage downstream of liquid coolant in this area.

The 20% or less of coolant which does reach the downstream sides of the rolls 20 must also be removed from the strip 20 to avoid staining it, and this coolant is dealt with under the invention in the following manner.

Slightly beyond the downstream sides of the working rolls 20 upper and lower headers 33 and 34 are positioned slightly above and below the strip 22. The upper header 33 is hinged at 35 to the lower header for raising and lowering at proper times by a power cylinder 36 to facilitate threading the strip 22 initially between the headers. The entire assembly is firmly supported adjacent to the working rolls 20 by conventional means, not shown.

The interiors of the headers 33 and 34 communicate at their ends away from the hinge 35 through fittings 37 which abut when the two headers are in parallel relationship. Similar communicating fittings 38 can be provided close to the hinge 35. The two headers have slots 39 in their respective bottom and top walls, FIG. 5, across the width of strip 22.

A pair of aspirators 40 are mounted in the bottom wall of lower header 34 to produce a partial vacuum in the two headers when the aspirators are energized with compressed air delivered to the lower header 34 through a port 41 at a pressure of 80–100 psi. The aspirator units are conventional and are preferably of a type manufactured and sold by Vortec, Inc., Cincinnati, Ohio, and called "Air Amplifiers". Aspirated coolant spray or droplets pulled from the two headers by the aspirators 40 are delivered through large hoses 42 to the aforementioned reclaiming or recycling point. It might be mentioned that the type of oil employed as a coolant in the mill costs about $1.50 per gallon, and a feature of the invention is its ability to reclaim this product.

The downstream coolant removal component of the invention in addition to the described aspirator means comprises positive pressure opposing air blast means to direct air onto the top and bottom faces of the strip 22 for the purpose of dislodging the remaining coolant from the strip and rendering it airborne, so that the aspiration system can drawn the airborne droplets through the slots 39 and into the headers and then through the aspirators 40 and the two hoses 42 which delivers the droplets to the reclaiming point. At the same time, the system rids the surrounding environment of these coolant droplets which could otherwise endanger the health of workers in the near vicinity of the coolant spray apparatus.

The positive pressure air blast means of the downstream unit comprises apertured air nozzle blocks 43 welded or otherwise secured within the two downstream corners of the headers 33 and 34. The individual nozzles 44 seated in these blocks deliver air blasts 45, FIG. 7, downwardly and upwardly against the strip 22 as the latter moves between the headers, preferably in a direction somewhat to the reverse of strip movement to dislodge the liquid coolant from the strip and render the coolant airborne and drive it toward the slots 39.

Figure 4:
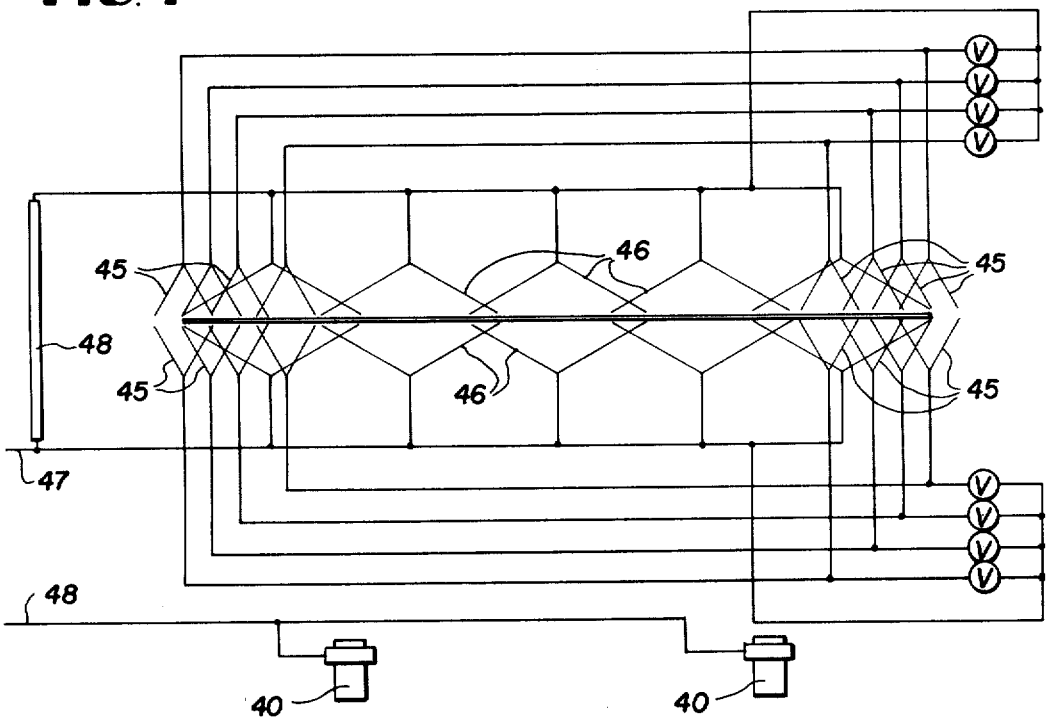
FIG. 4 is a schematic view of the system shown in FIG. 3.

As best shown in FIG. 4, the air jets 45 are concentrated near the two edges of the strip 22 beyond the ends of rolls 20. A plurality of wider angle air jets 46 across the center area of the strip are active continuously during the coolant removal process, whereas the more concentrated edge air blasts or sprays 45 are individually digitally controlled in the manner described for the air blasts 32 of the upstream component of the invention, in accordance with the teachings of the aforementioned patent.

Compressed air at 80–100 psi is also delivered to an inlet port 47 of the downstream component to simultaneously power the top and bottom banks of pneumatic nozzles producing the air jets 45 and 46 impinging on the top and bottom faces of the fast moving strip 22. A flexible hose 48 interconnects the top bank of air nozzles with the bottom bank, as shown in the drawings.

It may now be seen, in light of the foregoing description, that a method of cooling the working rolls of a metal strip rolling mill is provided in which liquid coolant is simultaneously removed or cleaned from the strip prior to coiling the strip to avoid staining it. The method involves directing pressurized air jets onto the rolls and aiming these jets toward the ends of the rolls outwardly of the longitudinal edges of the strip at the upstream side of the rolls while the rolls are being cooled. Simultaneously, near the downstream side of the rolls, angled pressurized air jets aimed in opposition to the path of movement of the strip are directed onto both sides of the strip across the full width of the strip to dislodge any remaining coolant from the strip. The dislodged coolant is airborne, and a simultaneous coacting aspirator system including headers above and below the strip pulls the airborne coolant away from the vicinity of the strip and conveys the coolant to a remote reclaiming point, leaving the metal strip substantially free of liquid coolant and clean. The surrounding working environment is also rendered free of pollution due to the airborne coolant.

As used herein, the term "air" is intended to include other gases such as nitrogen and other fluids including the coolant itself, in some cases.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a metal strip rolling mill which includes at least a pair of working rolls one above the other and between which a metal strip travels on a substantially horizontal path of movement, a pair of coolant distribution headers disposed near the upstream sides of the working rolls, one above and one below the metal strip, remotely controllable liquid coolant distribution nozzle units on said headers in communication therewith and delivering liquid coolant onto the upstream sides of the working rolls at least across the width of the metal strip, a pair of pneumatic headers extending along the bottom and top of the coolant headers, compressed air nozzle units which are remotely controllable connected with said pneumatic headers and adapted to direct the streams of compressed air onto the upstream faces of the working rolls near and above and near and below the metal strip, the compressed air nozzle streams being directed toward the two longitudinal edges of the metal strip and toward the opposite end portions of the working rolls which extend outwardly of the strip longitudinal edges to thereby prevent most of the liquid coolant delivered onto the upstream sides of the working rolls from passing through the rolls and downstream thereof, another pair of headers disposed slightly downstream of the working rolls, one above and one below the metal strip and spanning the width of said strip, the last-named headers having opposing evacuation slots across the top and bottom face of said strip in closely spaced relationship thereto, said evacuation slots being disposed near the upstream sides of the last-named headers with respect to the direction of movement of the strip, means connected with the last-named headers to evacuate their interiors, whereby the evacuation slots can remove air suspended liquid coolant particles from the regions close to the strip and last-named headers on opposite sides of the strip, and compressed air nozzle means on the last-named headers near and slightly downstream from the evacuation slots and being adapted to deliver multiple streams of compressed air onto opposite sides of the strip in somewhat upstream directions to lift liquid coolant remaining on the strip therefrom and rendering such coolant airborne in the vicinity of the evacuation slots.

2. In a metal strip rolling mill as defined in claim 1, and axially rotatable compressed air nozzles on said compressed air nozzle units and each having a side discharge aperture whereby the compressed air streams from such nozzles can be finely adjusted in their directions relative to the metal strip and working rolls.

3. In a metal strip rolling mill as defined in claim 1, and said compressed air nozzle means on the last-named headers including a first group of compressed air nozzles close to the evacuation slots for delivering streams of compressed air uniformly across the central portion of the strip, and second groups of compressed air nozzles slightly downstream from the first group for delivering more concentrated compressed air streams onto opposite longitudinal edge areas of the strip where remaining liquid coolant is likely to be more concentrated.

4. Apparatus for substantially completely removing liquid coolant from a moving metal strip in a metal rolling mill or the like having a stand of working rolls, the apparatus comprising a first compressed air delivery nozzle means disposed near the upstream side of said roll stand and delivering multiple compressed air streams onto the working rolls with the air streams having their axes angled toward the opposite end portions of the rolls to thereby remove most of the liquid coolant from the working rolls at their upstream sides, and a separate and independently operable downstream liquid coolant removal means spaced from the downstream side of the roll stand operable for removing substantially completely any liquid coolant remaining on the metal strip downstream of the roll stand, the downstream liquid coolant removal means comprising a pair of opposing closely spaced parallel headers spanning the metal strip above and below the same, each header having an evacuation slot in its wall facing said strip near the upstream side of the header with relation to the direction of movement of the strip, means to evacuate the interiors of said headers whereby suspended coolant particles can be drawn into the headers through said slots for remote disposal, and compressed air nozzle means on the headers slightly downstream of said slots and directing streams of compressed air onto the top and bottom sides of said strip across the width of the strip with the axes of the air streams angled somewhat upstream with relation to the path of movement of the strip to lift liquid coolant from the top and bottom faces of the strip in the vicinity of said evacuation slots.

5. Apparatus as defined in claim 4, and said compressed air nozzle means on the headers including two groups of air nozzles on the headers across the strip, one group nearest the evacuation slots delivering compressed air streams evenly across the center portion of the strip, and the other group of air nozzles delivering more concentrated air streams onto the opposite longitudinal edge portions of the strip where remaining liquid coolant tends to be more concentrated.

* * * * *